US005765550A

United States Patent [19]

Psaros et al.

[11] Patent Number: 5,765,550

[45] Date of Patent: Jun. 16, 1998

[54] DEVICE FOR FIXING AND SEALING A $CO^2$ ABSORBER CONTAINER AND A COVER WHICH PERMITS RAPID DETACHMENT AND REAFFIXING

[75] Inventors: Georgios Psaros, Tullinge; Olle Östedt, Kista, both of Sweden

[73] Assignee: Siemens Elema AB, Solna, Sweden

[21] Appl. No.: 702,171

[22] Filed: Aug. 23, 1996

[30] Foreign Application Priority Data

Oct. 4, 1995 [SE] Sweden ..... 9503436

[51] Int. Cl.[6] ..... A62B 9/04; A62B 7/10; A62B 19/00; A62B 23/02

[52] U.S. Cl. ..... 128/202.27; 128/205.27; 128/205.12; 128/205.28

[58] Field of Search ..... 128/202.27, 205.12, 128/205.28, 205.17, 205.27, 205.29, 206.17

[56] References Cited

U.S. PATENT DOCUMENTS

| | | | |
|---|---|---|---|
| 2,345,530 | 3/1944 | Connell | 128/205.28 |
| 3,088,810 | 5/1963 | Hay | 128/205.28 |
| 3,794,027 | 2/1974 | Johnson . | |
| 3,830,632 | 8/1974 | Guzay | 128/205.28 |
| 4,086,923 | 5/1978 | Henkin | 128/205.12 |
| 4,108,172 | 8/1978 | Moore, Jr. | 128/205.12 |
| 4,832,018 | 5/1989 | Pantaleon-Stemberg . | |
| 5,222,488 | 6/1993 | Forsgren . | |
| 5,358,689 | 10/1994 | Jones et al. | 422/46 |

FOREIGN PATENT DOCUMENTS

| | | |
|---|---|---|
| 1 137 957 | 10/1962 | Germany . |
| 501 729 | 3/1994 | Sweden . |

OTHER PUBLICATIONS

Operating Manual for Servo Anesthesia circle 985 (Siemens, 1987) p. 8:6.

*Primary Examiner*—Kimberly L. Asher
*Attorney, Agent, or Firm*—Hill & Simpson

[57] ABSTRACT

A device for fixing and sealing a container having an open frontal side against a cover which permits detaching the container from the cover, in particular an absorber container for carbon dioxide in a respiration apparatus, allows the absorber container to be quickly detached so that it can be rapidly emptied or filled, and the absorber container can then be quickly reaffixed and sealed gas tight. For this purpose, a sealing and fixing arrangement is disposed along the longitudinal side of the container against the open frontal side thereof so as to be displaceable into two end positions, whereby in the first end position the arrangement has a shorter distance to the open frontal side of the container than in the second end position. An element is arranged on the cover, which forms a groove-shaped opening, the opening being dimensioned such that when sealing and fixing arrangement is brought into the first end position, the container and/or the arrangement can be introduced into the groove-shaped opening, and when the arrangement is brought into the second end position, the open frontal side of the container is pressed against the cover.

9 Claims, 3 Drawing Sheets

DEVICE FOR FIXING AND SEALING A $CO^2$ ABSORBER CONTAINER AND A COVER WHICH PERMITS RAPID DETACHMENT AND REAFFIXING

BACKGROUND OF THE INVENTION

1. Field of the Invention

The present invention is directed to a device for fixing and sealing a container having an open frontal side against a cover which permits detaching the container from the cover, in particular such a device as a part of an absorber container for carbon dioxide in a respiration apparatus.

2. Description of the Prior Art

A respiration apparatus, e.g. an anesthetic apparatus, has a respiration circuit, in which breathing gas circulates between a patient connected to the respiration circuit and a respiration reservoir. The gas exhaled by the patient is purified of carbon dioxide in an absorber container before being supplied to the patient in the next-following breathing cycle. A respiration apparatus of this type is specified in Swedish Published Specification 501 729. In this document, however, it is not disclosed how the absorber container is fixed to the respiration apparatus and sealed in order to avoid leakage of anesthetic gas into the surrounding atmosphere, or how the container is detached from the respiration apparatus so that saturated absorption material can be replaced with new material.

An anesthetic apparatus intended for use with larger animals is described in U.S. Pat. No. 3,794,027. This apparatus is provided with a cylindrical absorber container for carbon dioxide, which is equipped with wheels and is intended to stand on the floor. The container has a throat-shaped opening on its frontal side. Since the opening is relatively large, the container can easily be filled with absorption material and emptied of absorption material. The opening is sealed by means of a cork-shaped cover that is pressed into the throat-shaped opening, whereby a sealing ring, which is attached in a groove in the peripheral surface of the cork-shaped cover and which lies tightly against the surrounding inner wall of the throat-shaped opening, ensures that a good sealing of the absorber container can be achieved. Due to the relatively high friction that exists between the sealing ring and the opening, and due to the construction of the cork-shaped cover, it can be difficult to press in or to remove the cover.

The Siemens instruction manual "Servo Anesthesia Circle 985" for a commercially available anesthesia apparatus shows another absorber for carbon dioxide. This absorber container is, among other things, provided with a base plate and with a housing arranged so as to be detachable from the base plate, the housing having a relatively small opening through which the container can be filled with absorption material. After filling, the opening is provided with a cover. After a certain period of use, the absorption material is saturated, so that during an operation of longer duration it has to be changed while the patient is under the anesthetic. The operator must then detach the absorber container, empty it, attach it and then fill it again with absorption material. This can be time-consuming. Moreover, fragments of the absorption material, which is usually lime, can remain hanging from the inner wall of the opening when filling takes place in a hurried manner, which can lead to a small amount of leakage.

SUMMARY OF THE INVENTION

An object of the present invention is to provide a device of the type described above in which the absorber container can be detached quickly, so that it can be emptied or filled rapidly, and in which the absorber container can be fixed and sealed against gas extremely quickly.

This object is inventively achieved in an arrangement having sealing and fixing means arranged along the longitudinal side of the container, opposite the open frontal side thereof, so as to be displaceable into two end positions, whereby in a first end position the sealing and fixing means exhibit a shorter distance from the open frontal side of the container than in the second end position, and the arrangement also having an element, arranged on the cover, that forms a groove-shaped opening which is dimensioned in such a manner that when the sealing and fixing means are brought into a first end position the container and/or the sealing and fixing means can be introduced into the groove-shaped opening, and when the sealing and fixing means are brought into the second end position the open frontal side of the container is pressed against the cover. Only by displacement of the sealing and fixing means from the one end position to the other can the open frontal side of the container be fixed in a gas-tight manner against the cover, detached quickly from the cover.

In an embodiment of the invention, the cover and the element are fixedly arranged on the respiration apparatus. In this way, the operator can have both hands free to detach the container, take it out and empty it, as well as to fill the container and affix it.

In another embodiment of the invention, the sealing and fixing means are an annular collar at least partially surrounding the container, and having a handle or gripping element. Using the handle, the sealing and fixing means can easily be moved into the described end positions.

In a further embodiment of the invention, the sealing and fixing means include threads on the inner side thereof, the sealing and fixing means rotatably arranged along a segment of the container also provided with threads, the segment provided with threads having at least two, and preferably four, thread starts that are arranged in one plane. This allows the sealing and fixing means to be rotated into the aforementioned end positions. By using of a larger number of thread starts, the rotational motion of the sealing and fixing means from one end position to the other can be made very short. Moreover, a parallel displacement of the open frontal side of the container ensues in the direction of the cover, so that the entire surface of the open frontal side is simultaneously pressed against the cover and is fixed in a gas-tight manner. The surface of the open frontal side of the container can be cleaned beforehand with a towel, so that it is free of absorption material.

The thread starts are preferably distributed uniformly over the circumference of the container. This further ensures that during a rotation of the sealing and fixing means the container is displaced in the direction of the cover in a parallel fashion.

The container segment provided with the threads can be arranged in connection to the open frontal side of the container. In this way, the container is fixed in the area of its open frontal side, whereby the groove-shaped opening between the cover and the element is relatively narrow. In this way, the combination of the cover and the element occupies a negligible amount of space on the respiration apparatus.

The container segment provided with the threads can, of course, be attached in connection to the other, closed end of the container, with the result that the sealing and fixing means are displaceable in this area. In such a construction of the device, the groove-shaped opening is somewhat larger than the height of the container.

In another embodiment of the invention the open frontal side of the container is provided with a flange, and a groove is provided in the flange, running along it, and sealing and fixing means include a peg-shaped part that projects into the groove and runs in it when the sealing and fixing means are turned about the flange. In this way, the sealing and fixing means run in a stable manner during a rotation around the container, or against the flange. The flange permits a relatively large end surface to be obtained on the container, which is advantageous in sealing against the cover. The frontal side of the flange, or the side of the cover directed against the flange, is preferably provided with a rubber seal.

In a further embodiment of the invention the groove of the flange and the peg-shaped part are mutually arranged such that when the sealing and fixing means have been rotated into the first end position the peg-shaped part is located at one end of the groove, and when the sealing and fixing means have been rotated into the second end position the peg-shaped part is located at the other end. In this way, the operator can quickly displace the sealing and fixing means, e.g., from a second end position, in which the container is fixed against the cover, into a first end position, in which the container is detached from the cover, and vice versa.

The groove can also be provided with two projections, which are respectively located at a distance from the ends of the groove, this distance being somewhat larger than the width of the peg-shaped part of the sealing and fixing means. In this way the sealing and fixing means can be stopped in the two end positions.

DESCRIPTION OF THE PREFERRED EMBODIMENTS

Figure 1:
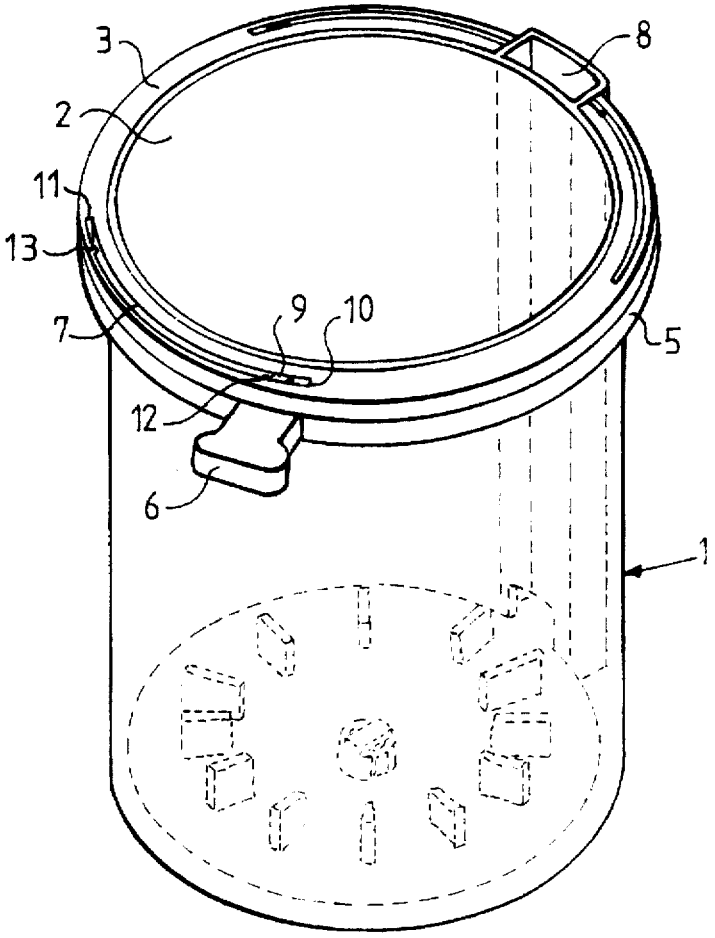
FIGS. 1 and 2 show an absorber container in a perspective view, with displaceable sealing and fixing means according to the invention on the container.

FIG. 1 shows a container for carbon dioxide absorption material. Such an absorber container for carbon dioxide is described in more detail in a larger context, i.e. as a part of an anesthesia system, in the aforementioned Swedish Published Specification 501 729. The container 1, which in this exemplary embodiment is cylindrical and is made of a transparent material, has an open frontal side 2. The open frontal side 2 of the container 1 is provided with a flange 3. A segment provided with threads is connected to the flange 3, this segment being shown and described in more detail in connection with FIG. 3, where it has the reference character 4. The container 1 is also provided with an annular collar 5 that partially surrounds the container 1, the collar 5 being provided on its inner side with threads and being rotatably arranged along the segment 4 provided with threads. The reason the collar 5 does not completely surround the container 1 is that in this exemplary embodiment the container 1 is provided with an exhalation line 8 attached along the outer wall of the container. The outer diameter of the collar 5 corresponds in this example to the outer diameter of the flange 3. The collar 5 additionally has a handle 6, so that the operator, using the handle 6, can turn the collar 5 against the flange 3 from a first end position (described in more detail below) into a second end position (described in more detail below).

FIG. 1 also shows that the flange 3 is provided with a groove 7 that runs along it. The collar 5 is provided with a peg-shaped part 9, which is attached precisely in front of the handle 6 and which projects into the groove 7 and runs in the groove 7 when the collar 5 is rotated about the flange 3. FIG. 1 shows the first end position, i.e. when the collar 5 has been rotated by means of the handle 6 into a position in which the collar 5 lies tightly against the flange 3. In this position, the peg-shaped part 9 is located at one end 10 of the groove 7.

Figure 2:
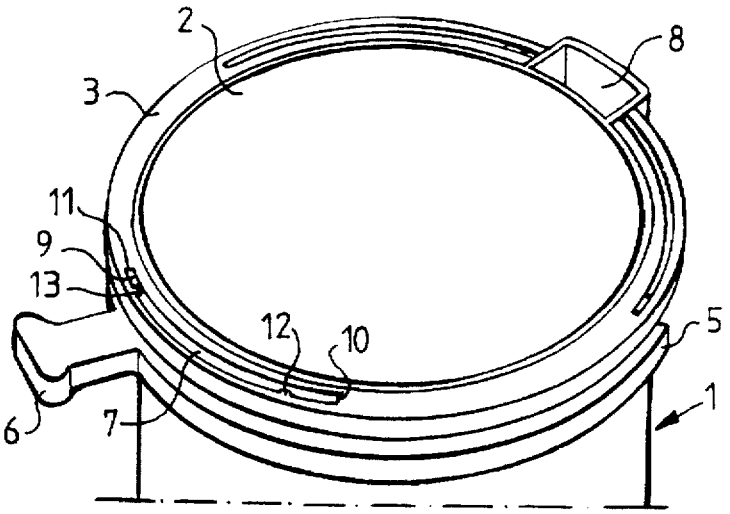

FIG. 2 shows the collar 5 in the second end position, i.e., when it has been rotated using the handle 6 into a position in which the collar 5 is attached at a distance from the flange 3. In this position, the peg-shaped part 9 is located at the other end of the groove 7. As shown in FIGS. 1 and 2, the groove 7 is provided with two projections 12 and 13, which are respectively attached at a distance from the ends 10 and 11 of the groove 7. This distance is somewhat larger than the width of the peg-shaped part 9. These projections 12 and 13 arrest the peg-shaped part 9, and thus the collar 5, when the part 9 is located in the positions shown, and the collar 5 can be detached therefrom only with a certain expenditure of force.

In FIGS. 1 and 2, further grooves and peg-shaped parts without reference symbols are shown. These grooves and peg-shaped parts serve to further stabilize the collar 5 when it is turned in relation to the flange 3.

Figure 3:
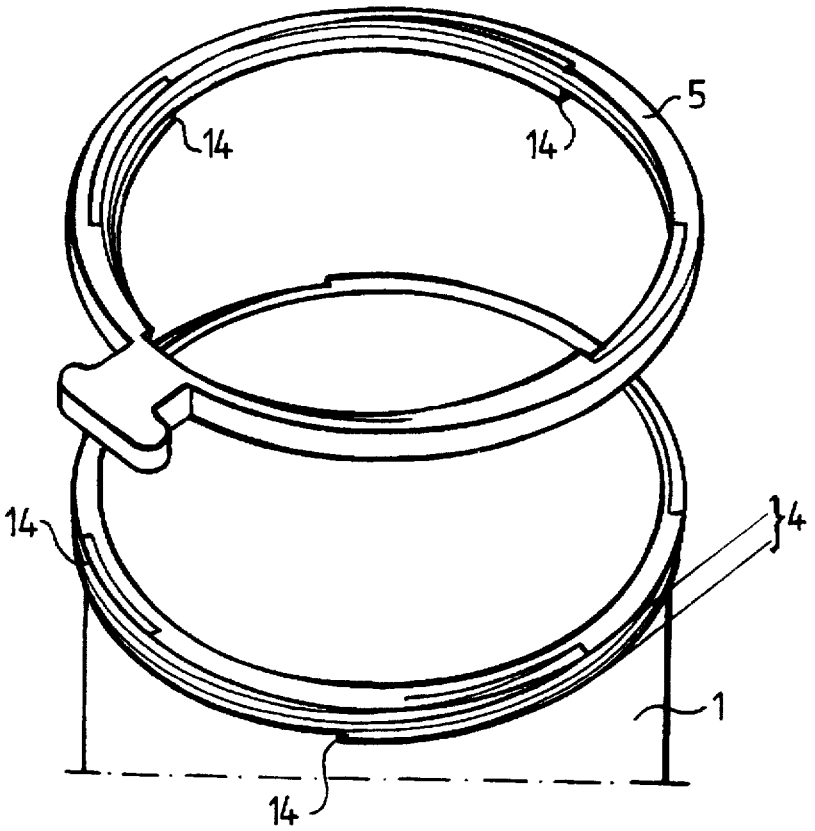
FIG. 3 shows a part of an absorber container according to FIG. 1, illustrating parts of the structure according to the invention.

FIG. 3 shows the segment 4 (specified in connection with FIG. 1), which is provided with threads, and the collar 5, which is provided with threads on its inner side. The important inventive feature is that the segment 4, provided with threads, and the collar 5, provided with threads on its inner side, have four thread starts 14, arranged on one plane. The thread starts 14 are preferably distributed uniformly over the circumference of the container 1. In FIG. 3, all the thread starts 14 cannot be shown. By means of this relatively large number of thread starts 14, the collar 5 can be displaced from the one specified end position to the other with a relatively small turning angle. In order to be able to show as many thread starts as possible, the collar 5 is drawn in this figure in such a way that it surrounds the entire container 1, which can be the case if the exhalation line 8 is not arranged along the outer wall of the container 1.

Figure 4:
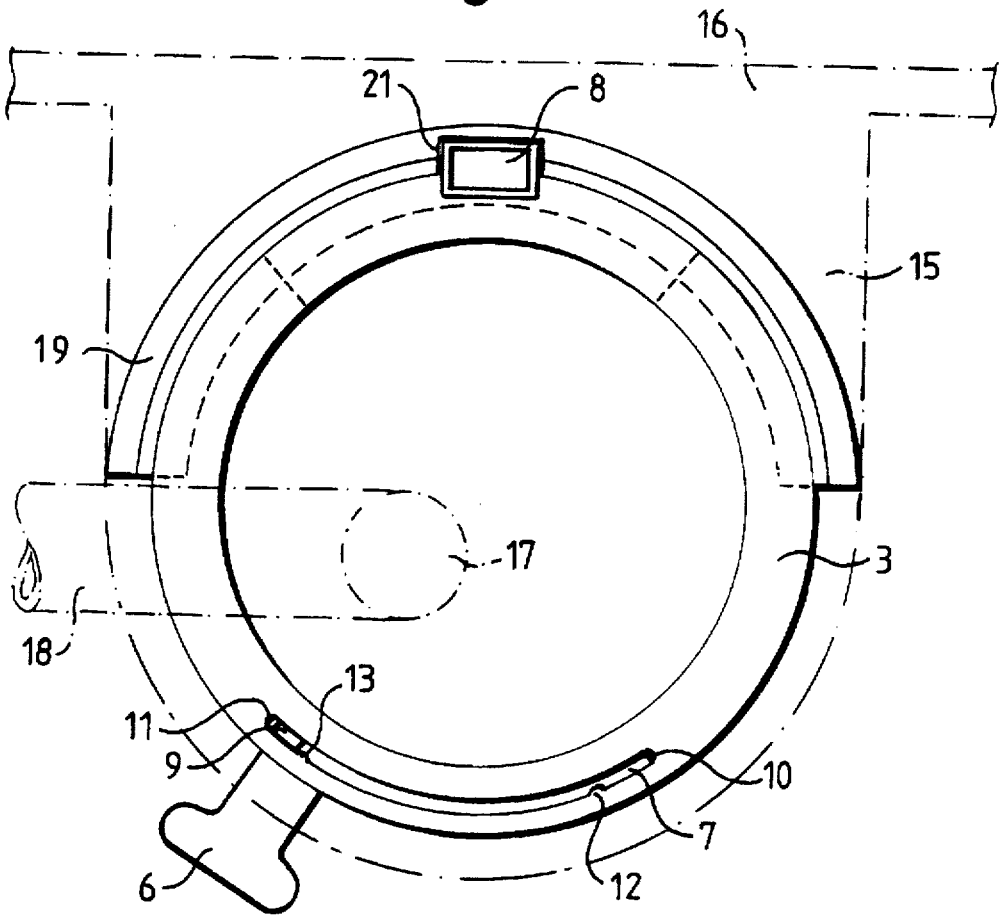
FIG. 4 is a top view of an absorber container according to FIGS. 1 to 3.

In FIG. 4, which shows a top view of the inventive device, a cover 15 for the absorber container 1 is shown in broken lines. FIG. 4 shows that the cover 15 is fixedly arranged on a respiration apparatus 16. An opening 17 for an exhalation line 18 is arranged in the cover 15, so that the exhalation gas from a patient connected to the respiration apparatus 1 can be led through the absorber container 1 and led out via the exhalation line 8. A semicircular element 19, having an L-shaped profile, is arranged on the cover 15, forming a groove-shaped opening 20, clearly shown in FIGS. 5 and 6. The semicircular element 19 and the groove-shaped opening 20 (FIGS. 5 and 6) are dimensioned so that, in the first end position of the collar 5, the flange 3 and the collar 5 can be led into the opening 20. The exhalation line 8 serves here as a guide piece, and is led into a recess 21, provided for this purpose in the element 19. In this way, the container 1 is fixed against rotation when the collar 5 is rotated from the first end position into the second end position.

Figure 5:
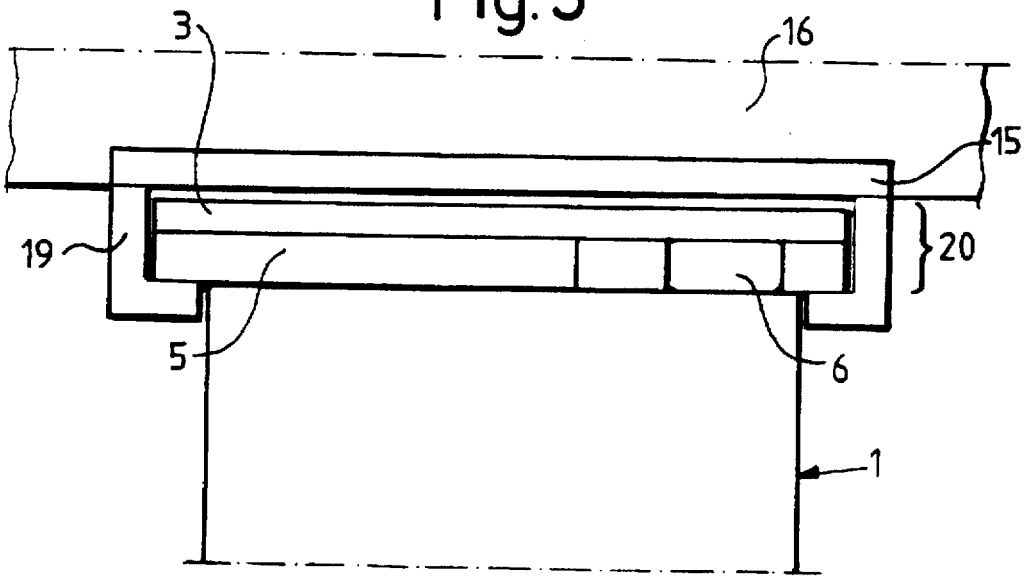
FIGS. 5 and 6 show side views of the absorber container and the device according to the invention respectively in first and second end positions.
Figure 6:
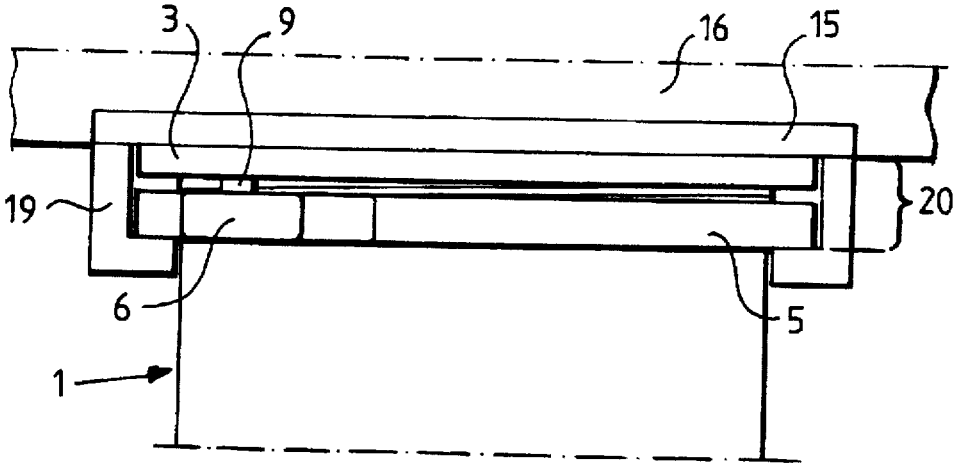

FIG. 5 clearly shows the element 19, which has an L-shaped profile, and which due to its shape forms the groove-shaped opening 20 between the cover 15 and the element 19. This opening 20 is dimensioned such that when the collar 5 is brought into a first end position, i.e. when the collar 5 lies tightly against the flange 3, the container 1, as already mentioned, can be led into the opening 20, as shown in FIG. 5, and, when the collar 5 is brought into the second end position, the flange 3 lies against the cover 15 in a gas-tight manner, as is shown in FIG. 6. When the absorption material is to be changed, the collar 5 is rotated into the first end position, whereby the container 1 is quickly detached from the cover 15 and can be led out of the opening 20.

The segment 4 provided with threads and the collar 5 can be attached to the closed end of the container 1. In such an embodiment, the collar 5 can lie in a first end position in the same plane as the closed end of the container 1. In a second end position, the collar 5 lies in a plane that is farther from the open end of the container 1 than is the closed end of the container 1. The groove-shaped opening 20 between the cover 15 and the element 19 must then be correspondingly large.

By means of the number of thread starts 14 according to the invention, a very precise parallelism in the displacement of the collar 5 against the flange 3 is achieved during rotation of the collar 5 about the container 1, which is important during the fixing and sealing of the container, since by this means the flange 3 lies in a gas-tight manner against the cover 15 over its entire surface directed against the cover 15. By means of the invention, the container 1 can be detached quickly from the cover, emptied of absorption material, filled therewith, and subsequently quickly affixed again against the cover 15 in a gas-tight manner.

The specified device described herein can also be used in connection for affixing and sealing a bag-and-bottle container against a cover and for detaching such a container from the cover.

Although modifications and changes may be suggested by those skilled in the art, it is the intention of the inventors to embody within the patent warranted hereon all changes and modifications as reasonably and properly come within the scope of their contribution to the art.

We claim as our invention:

1. An absorber container for carbon dioxide in a respiration apparatus comprising:

an absorber container body having an open upper end with a circumference:

a flange on said absorber container body extending fully around said circumference:

a cover for closing said open upper end of said absorber container body and an element disposed on said cover forming a groove-shaped opening;

a rotatable collar disposed below said flange and surrounding said open upper end for interacting with said element on said cover so that as said collar is rotated said collar moves substantially perpendicularly, relative to a plane containing said circumference, between first and second end positions solely by rotation of said collar, said first end position being disposed a shorter distance from said open upper end of the container than said second end position; and said element forming said groove-shaped opening on said cover having dimensions for permitting said collar to be introduced into said groove-shaped opening when said collar is in said first position, and said collar exerting a pressing force along an entirety of said flange to press said open upper end of said container air-tight against said cover when said collar is rotated into said second end position.

2. A device as claimed in claim 1 wherein said collar comprises an annular collar at least partially surrounding said container, said annular collar having a manually accessible handle attached thereto.

3. A device as claimed in claim 1 wherein said collar comprises first threads disposed on an inner side of said collar and second threads disposed along a segment of said absorber container body, said first and second threads rotatably interacting, and said segment of said absorber container body having said second threads having at least two thread starts disposed in a single plane.

4. A device as claimed in claim 3 wherein said segment having said second threads has four of said thread starts.

5. A device as claimed in claim 3 wherein said thread starts are disposed uniformly around a circumference of said container.

6. A device as claimed in claim 3 wherein said segment having said second threads is disposed in connection with said open frontal side of said absorber container.

7. A device as claimed in claim 1 wherein said flange has a groove running along a circumferential direction of said flange, and said device further comprising a peg extending into said groove and riding in said groove when said collar is rotated around said flange.

8. A device as claimed in claim 7 wherein said groove in said flange and said peg are relatively disposed for, when said collar is in said first end position, causing said peg to be located at one end of said groove, and when said collar is in said second end position, for causing said peg to be located at an opposite end of said groove.

9. A device as claimed in claim 8 wherein said collar further comprises two projections disposed in said groove respectively at a distance from said ends of said groove, said distance being larger than a width of said peg.

* * * * *